US005970989A

United States Patent [19]

Litton

[11] Patent Number: 5,970,989

[45] Date of Patent: Oct. 26, 1999

[54] MAKEUP KIT

[75] Inventor: Garfield Litton, Glenrock, N.J.

[73] Assignee: Revlon Consumer Products Corporation, New York, N.Y.

[21] Appl. No.: 09/173,834

[22] Filed: Oct. 16, 1998

Related U.S. Application Data

[63] Continuation of application No. 08/878,877, Jun. 19, 1997, abandoned.

[51] Int. Cl.[6] ..... A45D 40/28

[52] U.S. Cl. ..... 132/218; 132/317

[58] Field of Search ..... 132/317, 318, 132/320, 313, 314, 218, 297; 401/17, 18, 19, 23, 24, 37, 38, 123, 125, 126

[56] References Cited

U.S. PATENT DOCUMENTS

| | | | |
|---|---|---|---|
| D. 370,088 | 5/1996 | Burns | D28/76 |
| 2,829,655 | 4/1958 | Bau | 132/218 |
| 3,073,320 | 1/1963 | Seaver | 132/317 |
| 3,103,032 | 9/1963 | Brenne | 132/317 |
| 3,763,870 | 10/1973 | Montgomery et al. | 132/218 |
| 3,764,221 | 10/1973 | Solenghi | 401/129 |
| 3,896,823 | 7/1975 | Spatz | 132/218 |
| 4,711,354 | 12/1987 | Bennett | 132/218 |
| 4,740,097 | 4/1988 | Kapustin | 401/35 |
| 4,886,080 | 12/1989 | Cole | 132/317 |
| 5,002,415 | 3/1991 | Gueret | 401/126 |
| 5,116,154 | 5/1992 | Fulkerson | 401/127 |
| 5,123,431 | 6/1992 | Wilson | 132/320 |
| 5,509,742 | 4/1996 | Balzarini | 401/18 |
| 5,620,270 | 4/1997 | Gueret | 132/218 |
| 5,794,632 | 8/1998 | Gueret | 132/317 |

*Primary Examiner*—Todd E. Manahan
*Assistant Examiner*—Eduardo C. Robert
*Attorney, Agent, or Firm*—Julie Blackburn

[57] ABSTRACT

A makeup kit comprising a reservoir for cosmetic product containing one opening, a first closure for the reservoir which has an inner surface and an outer surface forming a compartment having an open upper end within the first closure, affixed to the inner surface of the first closure an applicator for cosmetic product, a second closure for the compartment within the first closure, the second closure having an inner surface and an outer surface, and attached to the inner surface of the second closure, an accessory for use with the cosmetic product.

3 Claims, 2 Drawing Sheets

MAKEUP KIT

This is a continuation of copending application(s) Ser. No. 08/878,877, filed Jun. 19, 1997, now abandoned.

TECHNICAL FIELD

The invention is in the field of devices for applying and storing cosmetic products.

BACKGROUND OF THE INVENTION

Many cosmetic products are designed to be used together, such as lipstick and lipliner, mascara and brow products, and so on. Or often it is desireable to apply cosmetic and then use various grooming devices to enhance the applied cosmetic. For example, many women apply mascara and then use brushes to brush the lashes or groom the brows. Because companion products and grooming devices are separately purchased by consumers, consumers will often carry the most important item and leave the accessory device or companion product at home in their makeup case to avoid having to carry many small items. Thus, single makeup kits which contain the products commonly used together, or in the alternative, grooming devices for use with the cosmetic products that are applied are very helpful. However, if these kits are too large and unwieldy consumers will find them inconvenient. Ideally, the kits should be as close as possible to the shapes and sizes that consumers are currently accustomed to.

For example, mascara is sold in containers comprised of a reservoir for holding mascara, a lid, and an applicator brush secured to the under side of the lid. When the lid is in the closed position, the brush is immersed into the mascara product in the reservoir. When the user desires to apply mascara to the eyelashes, the lid is removed and the brush is extracted from the reservoir through the wiping system. A certain amount of mascara product adheres to the brush and is applied to the eyelashes.

Often, it is necessary to further groom the eyelashes after applying mascara. Sometimes eyelashes stick together causing mascara to cake or glob on the lashes. Mascara users have been known to use a variety of objects such as safety pins, tweezers, and the like, to separate the eyelashes after mascara has been applied. Obviously this is not safe or hygienic. Additionally, it may also be desired to groom the eyebrows at the same time mascara is being applied. Mascara wands are generally not optimal for brow grooming.

Also, products like lipstick and lipliner are often used together. Most women carry lipstick in their purse, but will often not bother to carry lipliner. However, if a lipstick kit is designed to be of a convenient size and shape and contains both items, women would carry both items.

Thus, there is a need for a makeup kits when enable carrying of companion products or products and grooming devices in one single unit.

The object of the invention is to provide an eye makeup kit which enables application of mascara and at the same time provides an accessory device for brow grooming and combing of the lashes.

The object of the invention is to provide an eye makeup kit for application of mascara to the eyelashes, combing of the eyelashes, and brow grooming.

The object of the invention is to provide a mascara applicator containing a comb in the lid of the container for use in brow grooming and lash combing.

SUMMARY OF THE INVENTION

An makeup kit comprising, in combination:

a) a reservoir for cosmetic product containing one opening, b) a first closure for said reservoir, said first closure having an inner surface and an outer surface, said outer surface forming a compartment having an open upper end within said first closure, c) affixed to said inner surface of said first closure, an applicator for said cosmetic product, d) a second closure for said compartment within said first closure, said second closure having an inner surface and an outer surface, and, e) attached to said inner surface of said second closure, an accessory for use with said cosmetic product.

DETAILED DESCRIPTION

Figure 1:
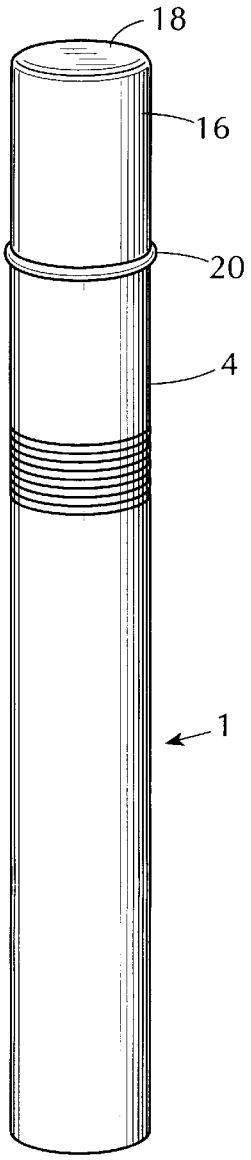
FIG. 1 is a perspective view of an eye makeup kit in the closed position, accordance with the first embodiment of the invention.

The first embodiment of the makeup kit of the invention 1 is illustrated in FIGS. 1–4. The kit contains a reservoir 2 for holding mascara 8. The reservoir 2 contains one opening 3. For the reservoir 2 there is a closure 4 which has an inner surface 5 and an outer surface 6, which outer surface 6 forms a compartment 7 within said closure 4. The compartment 7 serves as the storage place for the accessory, a brush 9 to be used to groom the brows or comb the lashes after application of the mascara found in the reservoir 2. Affixed to the inner surface 5 of the closure 4 is a mascara wand 10 containing a brush 11 at its distal end. When the closure 4 is secured to the reservoir 2, the brush 11 is immersed in the mascara 8. Generally, the inner surface 5 of the closure 4 contains threads 12 which engage with threads 13 found on the reservoir 2 so that the closure 4 can be screwed onto the reservoir 2 to form an air tight seal. Generally, the mascara wand 10 is made from a twisted metal wire 14 which grips the fibers 15 of the brush 11 between the coils of the twisted metal wire 14. There is a second closure 16 for the compartment 7 within the first closure 4. The second closure 16 has an inner surface 17 and an outer surface 18. Attached to the inner surface of the second closure 16 is a comb 9, used to brush lashes or groom brows. The comb 9 is attached to said surface 17 by means of a platform 19 which has a diameter which is slightly smaller than the diameter of the cylinder formed by the outer surface 18 of the closure 16.

Figure 3:
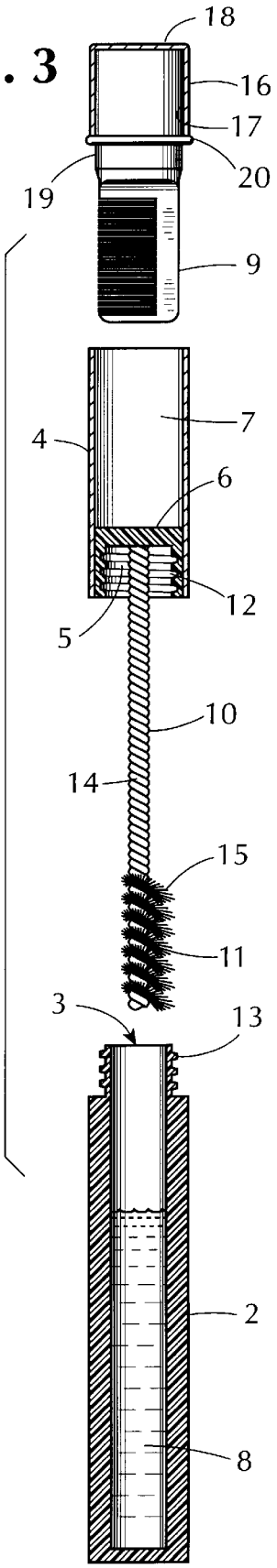
FIG. 3 is an exploded view of the makeup kit of FIG. 1.
Figure 2:
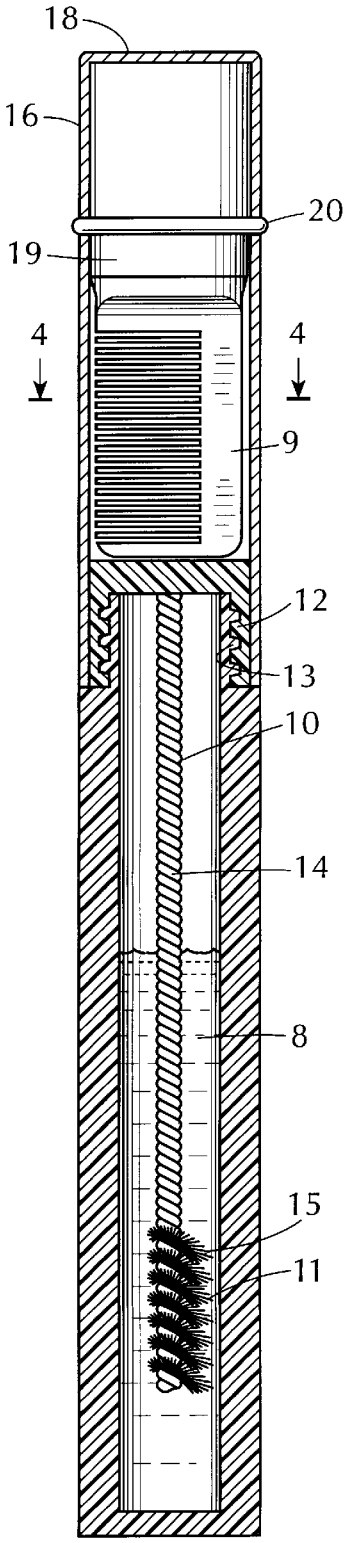
FIG. 2 is a cross sectional view of the eye makeup kit of FIG. 1 in the closed position.

FIG. 3 is an exploded view of the makeup kit showing how the various pieces fit together. When the kit 1 is in the closed position as shown in FIG. 2, the first closure 4 is affixed to the reservoir 2, permitting the mascara wand 10 to be immersed in the mascara 8 within the reservoir 2. The second closure 16 is affixed to the compartment 7 formed within said first closure 4, and the comb 9 fits within said compartment 7 which the platform 19 is of a diameter that permits it to snugly fit, forming a seal to the compartment 7. If desired, a bead 20 around the closure 16 slightly above the platform 19 forms a stop so that the closure 16 fits snugly onto the top of the compartment 7.

Figure 4:
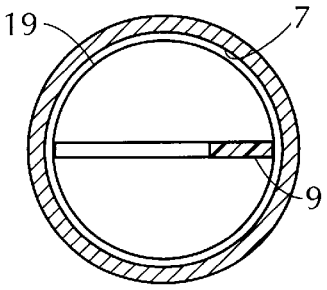
FIG. 4 is a cross sectional view taken across 4—4 of FIG. 2.

FIG. 4 is a cross-sectional view taken across 4—4 of FIG. 2, which shows a cross-sectional view of the comb 9.

Figure 5:
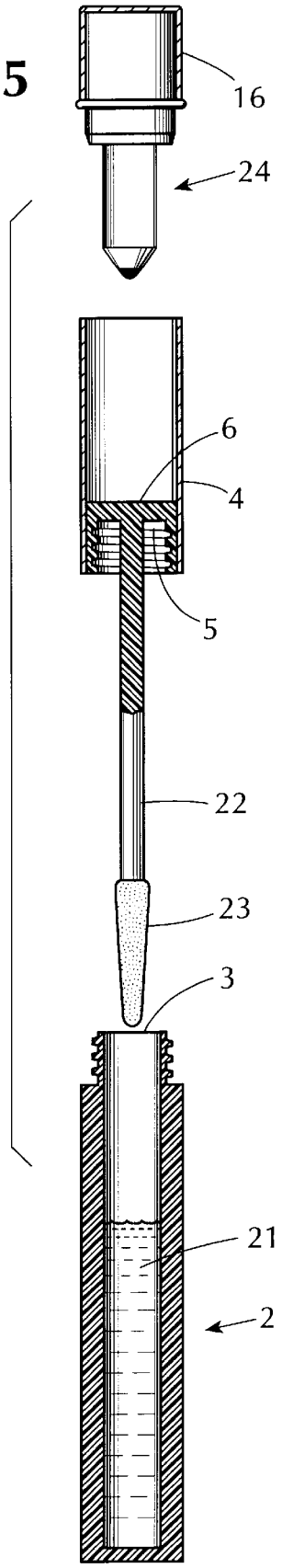
FIG. 5 is an exploded view of a lip makeup kit in accordance with the second embodiment of the invention.
Figure 6:
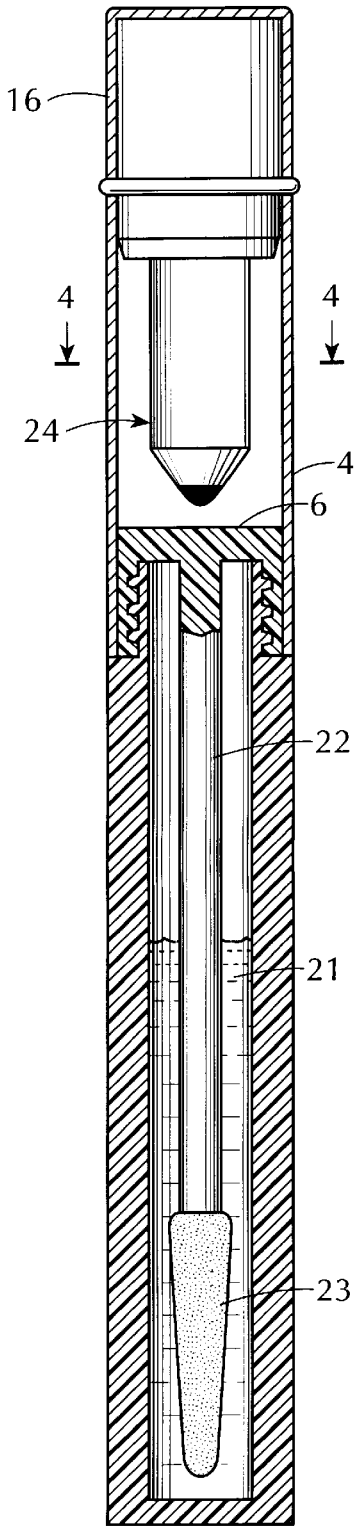
FIG. 6 is a cross-sectional view of the lip makeup kit of the invention.

FIGS. 5 and 6 illustrate another embodiment of the makeup kit 1 of the invention. FIG. 5 is an exploded view of a makeup kit having a reservoir 2 for containing a cosmetic product such as lip gloss of lip gel 21. The closure 4 closes the reservoir 2 and has an inner surface 5 and an outer surface 6 which forms a compartment 7 within said first closure 4. The compartment 7 serves as a reservoir for a product used with the lip gel 21, in this case a lipliner pencil 24. Attached to the inner surface 5 of the first closure 4 is a wand 22 having a deerfoot applicator 23 attached thereto. The deerfoot applicator 23 is used to apply the lip gel 21 found in the reservoir 2 to the lips. A second closure 16 serves as a closing means for the compartment. The second closure 16 has an inner surface 17 and an outer surface 18. Affixed to the inner surface 17 of the second closure 16 is a lipliner pencil 24.

While the invention has been described in connection with the preferred embodiment, it is not intended to limit the scope of the invention to the particular form set forth, but, on the contrary, it is intended to cover such alaternatives, modifications, and equivalents as may be included within the spirit and scope of the invention as defined by the appended claims.

I claim:

1. A makeup kit for applying mascara to the eyelashes and grooming the eyelashes and eyebrows comprising, in combination:

a) a reservoir for mascara containing one opening, b) a first closure for the reservoir, the first closure having an inner surface and an outer surface, the outer surface forming a cylindrical compartment having an open upper end within the first closure, c) affixed to the inner surface of the first closure, a mascara wand made from a twisted metal wire, d) a second closure for the compartment within the first closure, the second closure having an inner surface and an outer surface, and attached to the inner surface a platform having a diameter which is slightly smaller than the diameter of the cylindrical compartment formed by the outer surface of the first closure which platform fits snugly within the cylindrical compartment, and slightly above the platform, a bead which forms a stop; and e) attached to the platform on the inner surface, a comb for use with the mascara product.

2. The kit of claim 1 wherein the reservoir contains threads.

3. The kit of claim 2 wherein the inner surface of the first closure contains threads, and these threads are capable of mating with the threads on the reservoir to permit the first closure to be affixed to the reservoir to form an airtight seal.

* * * * *